United States Patent [19]

Parker

[11] Patent Number: 5,006,989

[45] Date of Patent: Apr. 9, 1991

[54] DIGITAL VITAL RATE DECODER

[75] Inventor: John W. Parker, Rochester, N.Y.

[73] Assignee: General Signal Corporation, Rochester, N.Y.

[21] Appl. No.: 364,286

[22] Filed: Jun. 12, 1989

Related U.S. Application Data

[63] Continuation of Ser. No. 12,540, Feb. 9, 1987, abandoned.

[51] Int. Cl.[5] ..... G06F 15/20; H03D 3/18

[52] U.S. Cl. ..... 364/426.05; 364/426.01; 246/182 C; 246/182 R; 375/103

[58] Field of Search ..... 364/426.05, 426.01, 364/424.01, 424.05; 246/182 R, 182 A, 182 B, 182 C, 5, 34 R, 34 B; 375/103; 340/352, 355

[56] References Cited

U.S. PATENT DOCUMENTS

| | | | |
|---|---|---|---|
| 4,217,643 | 8/1980 | Anderson et al. | 364/424 |
| 4,307,463 | 12/1981 | Sibley | 246/5 |
| 4,352,475 | 10/1982 | Smith et al. | 246/34 R |
| 4,495,578 | 1/1985 | Sibley et al. | 364/426 |
| 4,516,249 | 5/1985 | Cook et al. | 246/5 |
| 4,685,052 | 8/1987 | Sanders | 364/426 |
| 4,723,737 | 2/1988 | Mimoun | 246/182 R |
| 4,732,355 | 3/1988 | Parker | 246/182 R |
| 4,740,972 | 4/1988 | Rutherford, Jr. | 371/53 |
| 4,742,460 | 5/1988 | Hollands | 364/424 |

OTHER PUBLICATIONS

Bollinger, "Welco Working on Bartd Signaling", Dec. 1967, Railway Signaling and Communications, pp. 18–23.

Thorne-Booth, "Signaling of Remotely Controlled Railway Trains", Jun. 1968, IEEE, pp. 369–375.

*Primary Examiner*—Felix D. Gruber
*Assistant Examiner*—V. N. Trans
*Attorney, Agent, or Firm*—Martin Lukacher; Milton E. Kleinman

[57] ABSTRACT

This invention relates to cab signalling systems that receive various permissible maximum speed signals and decode the maximum speed signal to inform the engineman of a train of the current maximum safe speed that a train may travel. The apparatus of this invention accomplishes the foregoing by utilizing a single digital filter and a microprocessor to decode the various transmitted maximum speed signals and to verify that the decoded maximum speed signal represents one of the permissible maximum safe speeds.

18 Claims, 8 Drawing Sheets

DIGITAL VITAL RATE DECODER

This is a continuation of application Ser. No. 12,540, filed Feb. 9, 1987 now abandoned.

FIELD OF THE INVENTION

This invention relates to electronic devices and more particularly to automatic train protection devices that automatically indicate a maximum allowable safe train speed.

DESCRIPTION OF THE PRIOR ART

Cab signalling systems have developed to supply information and audible detection to an engineman on board a locomotive of a moving train. The cab signalling system will automatically inform the engineman of the maximum speed that the train may safely travel for the particular traffic situation that the train is currently experiencing. The engineman controls the speed of the train when the train speed does not exceed the maximum speed indicated by the cab signalling system. If the engineman exceeds the maximum speed or block conditions change to require a reduced maximum speed, an audible indicator warns the engineman that he has a predetermined time to apply the train brakes in a predetermined manner. If the engineman responds properly, he may release the brakes when the train's speed drops below the maximum allowable speed indicated by the cab signalling system. In the event the engineman fails to properly respond to the audible indicator, a train protection system may automatically apply the brakes and keep the brakes on until the train is brought to a full stop.

Typically cab signalling systems receive maximum speed limit information from signals that are transmitted through train rails. A transmitter transmits a signal that represents the maximum allowable speed limit at that instance in time. The transmitted signal is usually modulated at six different rates, with the highest modulation rate corresponding to the maximum allowable train speed, i.e., a rate of 75 cycles per minute may indicate a speed of ten miles per hour and a rate of 270 cycles per minute may equal a speed of eighty miles per hour. Two receiver coils individually mounted ahead of the locomotives's leading wheels, inductively pick up the transmitted signal. The cab signalling system will receive and decode the transmitted signal to determine the maximum allowable speed.

Prior art cab signalling system used six to twenty large LC filters or six to twenty active filters to process and decode the transmitted maximum speed signal. Thus, one to six filters were used to process each maximum speed signal. The indication of the maximum allowable train speed is considered a vital function, for the reason that if an erroneous maximum speed was indicated, the train may be travelling at an unsafe speed which may cause the train to run out of control and/or cause an accident.

Some of the disadvantages of the LC filters are that they are heavy, relatively expensive and require a great deal of space.

One of the problems encountered in using active filters are that active filters have a tendency to oscillate and produce an output signal when the filter has no input signal. Another problem in using active filters is that the output frequency of the filter is dependent upon the temperature. Thus, active filters may output erroneous maximum speed signals which may cause a train accident. In order to correct the foregoing problem the prior art utilized checking circuits which contain band pass and low pass filters to determine if a particular active filter was oscillating. The foregoing checking circuits add to the cost and complexity of the system.

SUMMARY OF THE INVENTION

This invention overcomes the disadvantages of the prior art by providing an inexpensive, reliable, lightweight, not very temperature dependent, vital, electronic circuit that replaces the active and/or LC filters of prior art cab signalling systems. The foregoing electronic circuit utilizes six digital filters implemented in a microprocessor to process the transmitted maximum speed signal to verify that the cab signalling system is processing the transmitted maximum speed signal. The apparatus of this invention accomplishes the foregoing by utilizing a single digital filter to process the six different maximum speed signals. At a given time the digital filter processes only one maximum speed and the microprocessor verifies that the output of the digital filter represents one of the six permissible maximum speed signals. The microprocessor will also drive a display that indicates the current allowable maximum speed. If the output of the digital filter does not correspond to a permissible maximum speed signal a failure has occurred in the cab signalling system, and a signal would be transmitted to the engineman indicating that the cab signalling system has malfunctioned. The cab signalling system would also stop processing maximum speed signals.

It is an object of this invention to provide a new and improved maximum speed signal processing and verification system for use in cab signalling systems.

It is another object of this invention to provide a new and improved verification system which determines that one of the permissible maximum speed signals is currently being processed.

It is a further object of this invention to provide a new and improved vital maximum speed signal processing and verification system that does not produce erroneous output signals.

Further objects and advantages of this invention will become more apparent as the following description proceeds, which invention should be considered together with the accompanying drawings.

DESCRIPTION OF A PREFERRED EMBODIMENT

Figure 1:
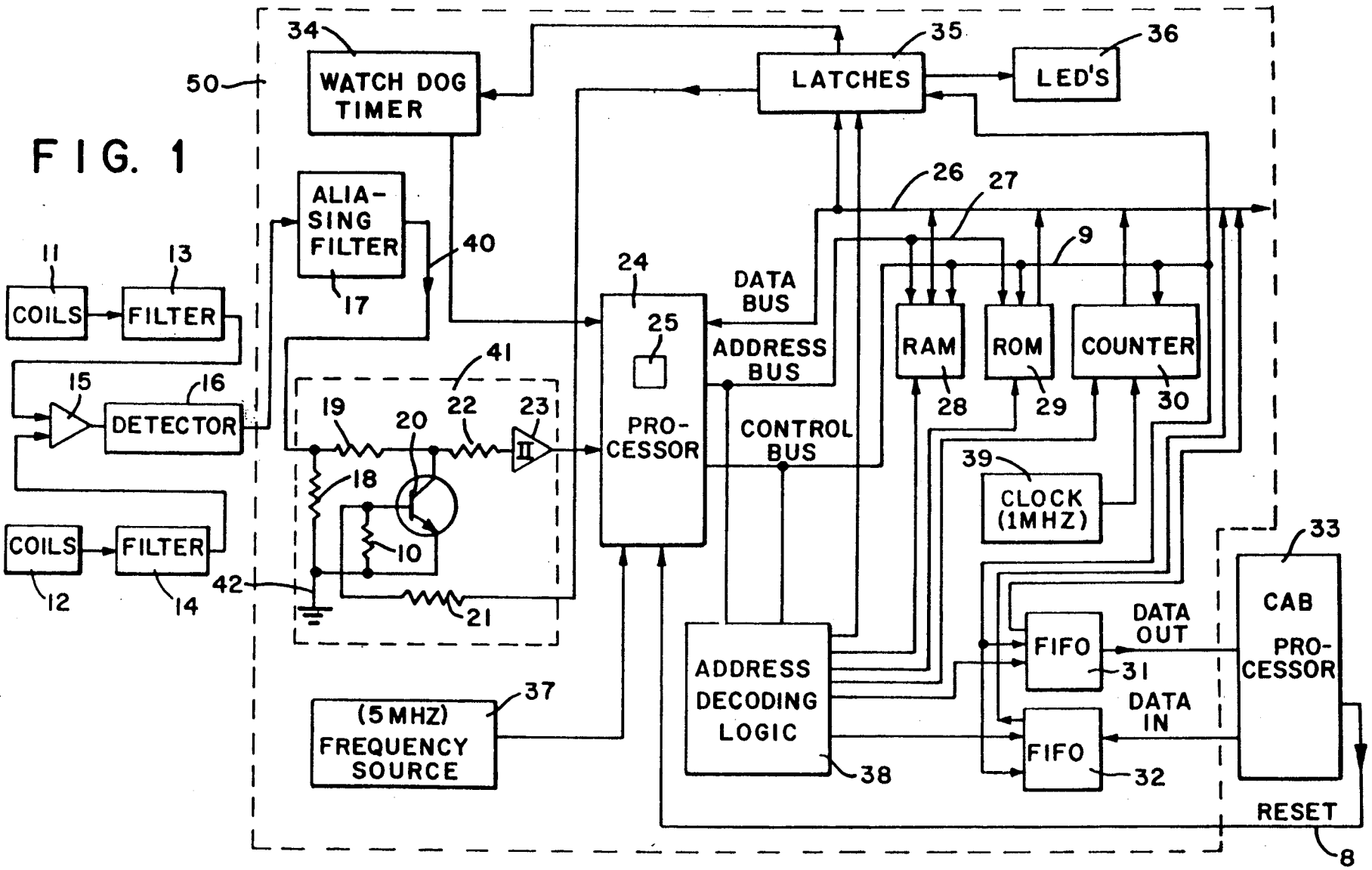
FIG. 1 is a block diagram of the apparatus of this invention.

Referring now to the drawings in detail, and more particularly to FIG. 1, the reference characters 11 and 12 represent a pair of train pickup coils which are on board a train. Coil 11 picks up the maximum speed signals transmitted on one rail and coil 12 picks up the maximum speed signals transmitted on the other rail. The output of coil 11 is transmitted to the input of carrier filter 13 and the output of coil 12 is transmitted to the input of carrier filter 14. The two inputs to amplifier 15 are the outputs of filters 13 and 14. Amplifier 15 amplifies its input signals and tranmits it to the input of envelope detector 16. The output of detector 16 is coupled to the input of the apparatus of this invention 50. The input to the apparatus of this invention is the input of aliasing filter 17. The output of filter 17 is coupled to the input of input test 41 via line 40. Input test 41 comprises: NPN transistor 20; resistors 10, 18, 19, 21 and 22; Schmidt trigger 23 and lines 40 and 42. Line 42 is the system common. Line 40 contains resistors 19 and 22 and the collector of transistor 20 is connected to one end of resistor 19 and one end of resistor 22. Resistor 18 is connected between lines 40 and 42. The base of transistor 20 is coupled to one of the ends of resistor 21, and the collector of transistor 20 is connected to one of the ends of resistor 22. The other end of resistor 21 is coupled to the output of latches 35 and the other end of resistor 22 is coupled to the input of Schmidt trigger circuit 23. The emitter of transistor 20 is coupled to line 42 and resistor 10 is coupled to the base of transistor 20 and Line 42. The output of Schmidt trigger 23 is coupled to one of the inputs of processor 24. Contained within processor 24 is scratch pad memory 25. Processor 24 is coupled to address decoding logic 38, RAM 28, ROM 29, Counter 30, Latches 35, Fifo 31 and Fifo 32 via control bus 9. Another input to processor 24 is the output of 5 MHz frequency source 37. TLhe output of watchdog timer 34 is also connected to one of the inputs of processor 24. Bus 26 is a bi-direction bus that is coupled to an input and output port of prcessor 24. Processor 24 will transmit data to latches 35 and fifo 31 via bus 26. ROM 29, counter 30 and fifo 32 will transmit data to processor 24 via bus 26. RAM 28 will receive data from processor 24 via bus 26 and RAM 28 will transmit data to processor 24 via bus 26. The output of processor 24 will be transmitted to the input of the address decoding logic 38, RAM 28 and ROM 29 via address bus 27. The first output of the address decoding logic 38 is coupled to one of the inputs of RAM 28 and the second output of logic 38 is coupled to one of the inputs of ROM 29. The third output of logic 38 is coupled to the input of counter 30 and the fourth output of logic 38 is coupled to the inputs of fifo 32. The fifth output of logic 38 is coupled to one of the inputs of latches 35 and the sixth output of logic 38 is coupled to one of the inputs of fifo 31. The output of clock 39 is coupled to the input of counter 30. One of the outputs of Processor 33 is coupled to one of the inputs of Processor 24 via reset line 8. Cab processor 33 receives data from fifo 31 and transmits data to fifo 32. The output of fifo 32 is transmitted to Processor 24 via data bus 26. One of the outputs of latches 35 is coupled to the input of LEDs 36 and one of the outputs of latches 35 is coupled to the input of timer 34. The third output of latches 35 coupled to one of the ends of resistor 21 and the other end of resistor 21 is coupled to the base of transistor 20.

Coils 11 and 12, filters 13 and 14, amplifier 15 and detector 16 are currently components of cab signalling systems that are used to detect maximum speed signals, which are transmitted over the rails. The output of detector 16 is essentially a continuous square wave signal that represents the current transmitted maximum speed, i.e. the maximum speed that the train may travel at this instance in time.

Aliasing filter 17, filters the continuous square wave signal and prevents the introduction of error into the continuous wave signal by removing signal components with frequencies too great to be analyzed during the sampling interval that contribute to the amplitude of lower frequency components.

Input test circuit 41 is used to insure that the apparatus of this invention 50 is not in oscillation. If apparatus 50 is in oscillation, the oscillation frequency would be aliased into the band of frequencies that apparatus 50 is detecting and an erroneous maximum speed signal may be transmitted to cab processor 33. Processor 33 may be a commercially available personal computer like the IBM XT P.C. A typical program for controlling the above-referenced P.C. in the environment of this invention is attached hereto as Appendix A. Input test circuit 41 samples the output of filter 17 once every processor 24 cycle to insure that processor 24 is receiving the correct maximum speed signal. The manner in which the input test is performed is as follows. At the beginning of each processor cycle processor 24 will send a signal to logic 38 via address bus 27. Logic 38 will decode the aforementioned signal and transmit this signal to one of the inputs of latches 35. Latches 35 are standardized latching circuits which are commercially available and may be purchased from Texas Instruments Incorporated.

The output of latches 35 passes through high resistance resistor 21 to the input of transistor 20. Transistor 20 will short the output of filter 17 to ground. Resistor 18 is used as a load for filter 17 and resistor 10 is a discharge resistor for transistor 20 (it permits transistor 20 to turn off in less time). Thus, when the output of filter 17 is shorted, no signal should be transmitted to processor 24 via high resistance resistor 22, and Schmidt trigger 23. If processor 24 received a signal from amplifier 23 at this time, processor 24 would know that apparatus 50 was in oscillation and erroneous maximum speed signals may be produced. Hence, processor 24 would stop processing data and apparatus 50 would be disabled. If processor 24 did not receive a signal from Schmidt trigger circuit 23 at this time, processor 24 would know that apparatus 50 was not producing any erroneous oscillations and that processor 24 may proceed to decode the maximum speed signals outputed by filter 17. Thus, when apparatus 50 was not receiving any erroneous oscillations processor 24 will process the continuous square wave maximum speed signals outputed by filter 17 and transmitted to processor 24 via line 40, resistors 19 and 22 and Schmidt Trigger 23. Schmidt trigger 23 will function as a level detector.

Processor 24 is a sixteen bit general purpose microprocessor which functions under control of the programs stored in ROM 29. Memory 25 is contained within processor 24 and is used by processor 24 as a scratch pad memory that temporarily store and perform calculations on the information being transmitted to processor 24. Processor 24 and memory 25 function under the control of the programs stored in ROM 29. A flow chart for the programs stored in ROM 29 is shown in FIGS. 2A through 2H. The aforementioned flow chart is hereinafter described.

Processor 24 will be used to decode the maximum speed signal outputed by filter 17 and to verify that the decoded signal is one of the permissible six maximum speed signals. Thus, processor 24 would replace the many LC or active filters that were used by the prior art to decode the transmitted maximum speed signal.

Frequency source 37, clock 39, address decoding logic 38 and counter 30 are used to control the timing of the program stored in ROM 29 and the timing of processor 24. Processor 24 operates on cycles that have specified intervals of time. For instance, at specified times processor 24: will address ROM 29 and logic 38 via address bus 27 and processor 24 will receive an instruction from ROM 29 via data bus 26; will address RAM 28 and logic 38 via bus 27 and transmit data to RAM 28 via bus 26; will address RAM 28 and logic 38 via bus 27 and processor 24 will receive data from RAM 28 via bus 26; will address logic 38 so that logic 38 will transmit a signal to FIFO 31 and FIFO 31 will transmit data to processor 24 via bus 26; will address logic 38 so that logic 38 will transmit a signal to fifo 32 and fifo 32 will transmit data to processor 24; will address logic 38 via bus 27 and transmit data to latches 35 via bus 26 so that logic 38 will transmit a signal to latches 35 and latches 35 will cause one of a plurality of LEDs 36 to be illuminated to indicate which one of the six maximum speed signals is currently being received by filter 17; will address logic 38 so that logic 38 may transmit a signal to latches 35 which will cause latches 35 to output a signal to timer 34. Timer 34 will time out and reset processor 24 if it does not receive a signal from latches 35 within a specified period of time. Therefore timer 34 receives a reset hold-off signal from latches 35. As long as the aforementioned hold-off signal periodically arrives at timer 34, timer 34 does nothing. In the event processor 24 malfunctions and does not generate a reset hold-off signal, timer 34 will time out and reset processor 24.

At the proper time processor 24 will place a signal on control bus 9 which will strobe data into and/or from the device addressed via bus 27 i.e., RAM 28, ROM 29, Latches 35, counter 30, FIFO 31 and FIFO 32, via data bus 26. Address decoding logic 38 is used to supply additional inputs to some of the components of this invention. Bus 27 requires 16 address lines and typical commercial chips have approximately 11 inputs. Thus, logic 38 is coupled to latches 35, RAM 28, ROM 29, Counter 30, Fifo 31 and Fifo 32 to supply additional inputs.

The foregoing is accomplished by frequency source 37, logic 38, clock 39 and counter 30. Five MHz frequency source 37 supplies clock pulses to processor 24 and one MHz clock 39 supplies clock pulses to counter 30. Counter 30 inputs counts to processor 24 at specified time sequences, i.e., when processor 24 transmits a counter 30 enabling signal to logic 38 via bus 37 and logic 38 sends a signal to counter 30.

The programs stored in ROM 29 is a synchronous program and it is necessary to assure that all possible branches of the program will arrive at program test points after completing the same number of cycles. Thus, the time difference between each set of program test points remains fixed when frequency source 37 and clock 39 operate correctly. If one clock changes with respect to the other, the time differences between the test points change. Thus, at each test point, an offset is added to the calculated time difference and the result used as a jump address to the following section of the program stored in ROM 29. If the time difference is correct, the jump will be made correctly. If the time difference is incorrect, the jump will be made incorrectly. Allowance is made for a count error of plus or minus one count, on either side of the target number in order to allow for slight variations in the rates of source 37 and clock 39. If the error is greater than this amount, the apparatus of this invention 50 will hang up in a series of traps placed around the target location. The target location contains a jump to the next 10 segment of code to be executed by the program.

Processor 24 will sample the continuous square wave output of amplifier 23 during certain specified time sequences, which are hereinafter described and calculate the current maximum speed that the train may travel at during this time. At the proper time processor 24 sends a signal to logic 38 via bus 27 and causes logic 38 to send a signal to FIFO 31 informing FIFO 31 that processor 24 is going to transmit the current maximum speed limit to FIFO 31 via bus 26.

Processor 24 repeatedly samples data from detector 16 and performs calculations based upon the sampled data. In order to perform the above calculations, processor 24 requires certain numbers (which have nothing to do with the speed limit) from cab processor 33. The numbers are transmitted from processor 33 to processor 24 via FIFO 32 and data bus 26. The manner in which the numbers are generated will be described as this description proceeds. After performing the calculations processor 24 produces a table of numbers which are transmitted from processor 24 to processor 33 via bus 26 and FIFO 31. The numbers on the above referenced table indicate the rate code (if one is present) and if processor 24 has performed the calculations correctly.

Processor 33 analyzes the table produced by Processor 24 to determine if a rate code is present, and determine if the numbers in the table belong to the very small subset of all possible numbers which indicate that processor 24 has performed its calculations correctly. If processor 33 determines that the number contained in the table are correct, processor 33 transmits to processor 24 (via Fifo 32 and data bus 26) a table of values which processor 24 utilizes to process its next data sample. In the event processor 33 determines that the numbers contained in the table are not correct, processor 33 does not transmit the numbers contained within the table to Processor 24. If processor 33 withholds the contents of the table from processor 24, processor 24 cannot continue to process inputs and produce outputs (which appear correct) which are transmitted to Processor 33.

FIGS. 2A through 2H show a detailed flow chart for the computer program stored within ROM 29. Character 51 represents a restart of the program stored in ROM 29 which may be initiated when processor 33 determines that processor 24 is not functioning correctly. If processor 33 determines that processor 24 is malfunctioning, processor 33 may not transmit the aforementioned table to processor 24 and/or processor 33 may reset processor 24 via line 8. Restarts of the program will also take place when apparatus 50 starts functioning and when processor 24 is not functioning properly and not repeatedly strobing watchdog timer 34. Watchdog timer 34 will then time out and reset processor 24.

The portion of the program represented by block 52 entitled "Initialize the System Hardware and Software" is used to reinitialize apparatus 50 and to clear RAM 29. After initialization the program proceeds to block 53 which request initialization data from processor 33 i.e., the first set of constants to be feed into filters needed to run the first program cycle. The generation of the constants will be hereinafter described.

The portion of the program represented by block 54 determines if data is currently available from processor 33. If data is currently not available the program will stop at this point and wait until data is available. If data is currently available the data is received and the program goes directly to block 55 entitled "Sample Timer and Save Result". The current count of counter 30 is read and stored in RAM 28. The program now proceeds to block 56 entitled "Sample Input Value" so that it can receive the current maximum speed signal outputed by filter 17.

Next block 58 begins the filter algorithm and sets N equal to the number of filters to be run. N will be set to equal 6 since we will process six different maximum speed signals (each maximum speed signal would be processed by software that represents a different filter). In block 59 of the program the filter parameters are loaded into the filter parameter areas of RAM 28. The portion of the program represented by block 60 entitled "Band Pass Filter" and the portion of the program represented by block 61 entitled "Level Detector" will be used to test the input to test circuit 41 i.e. check if the frequency of the input is within one of the six bands associated with the six rate codes. Essentially the foregoing implements a band pass filter which covers part of the range of frequencies that the input to test circuit 41 is expected to have. Next, block 62 will decrement N by one. Block 63 will cause the program to loop through blocks 59 through 63 until N equals 0. Thus, the program will loop through blocks 59 through 63 six times. When N equals 0 the program progresses to block 64 to load the test filters parameters and verify the input hardware.

Figure 2A:
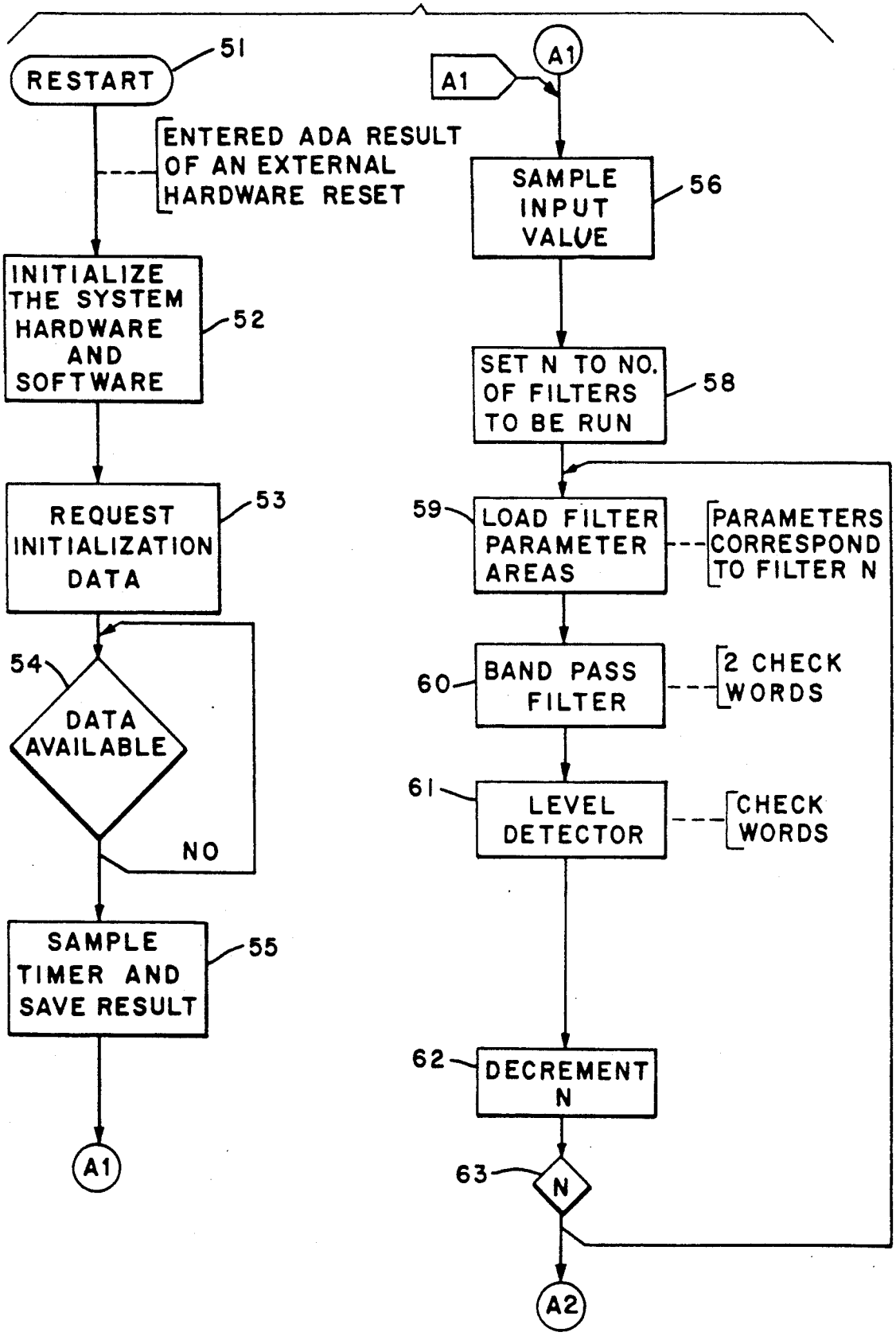
FIG. 2A–2H is a flow chart of the program that is stored in Rom 29 which is used to process the six maximum speed signals.
Figure 2B:
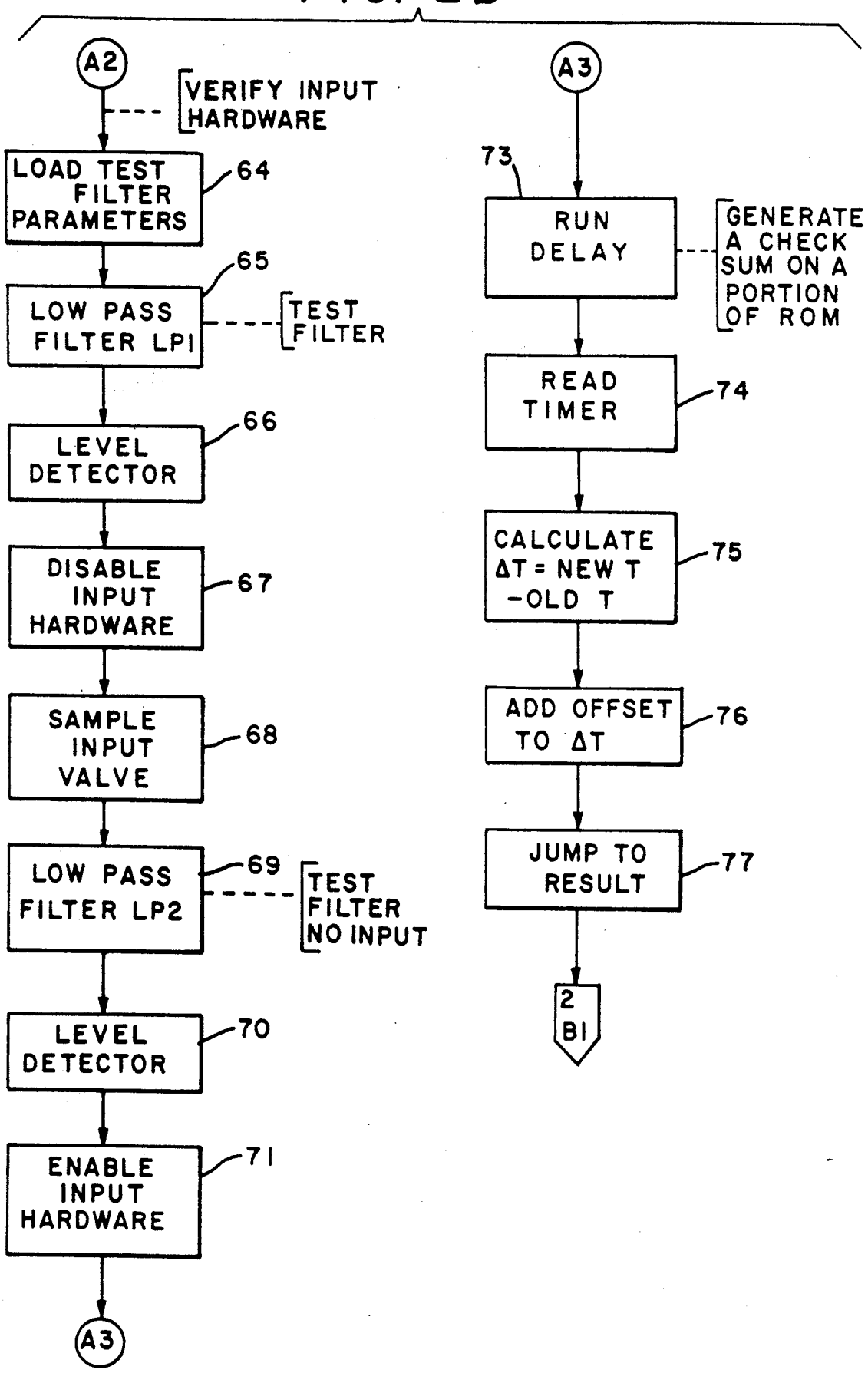
Figure 2C:
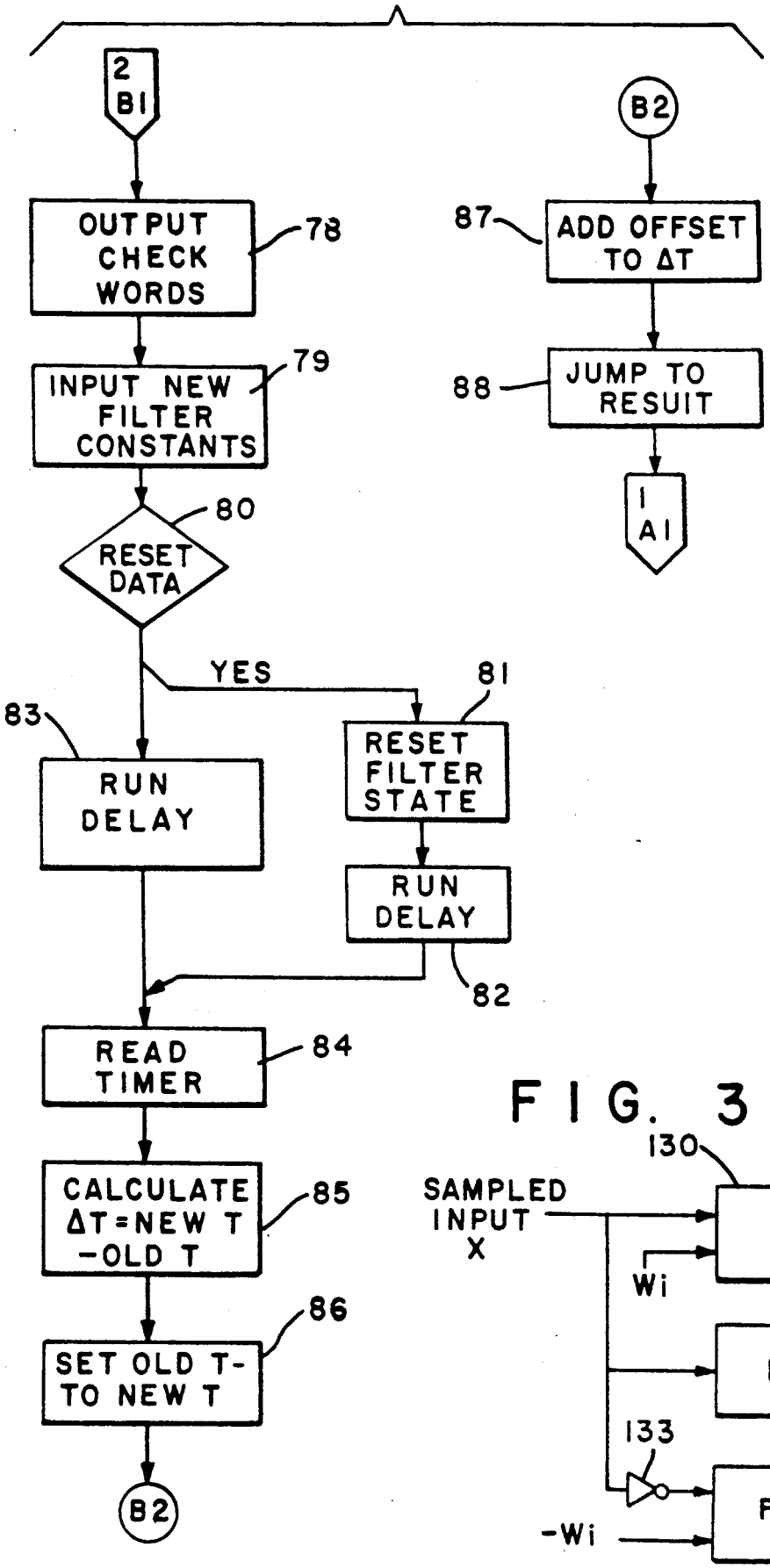

With its input shorted a filter should never produce an output. The only way in which it could produce an output is if a signal is oscillating somewhere in its circuitry. The purpose of the input test is to verify that the input circuitry is not oscillating. To test the inputs two low pass filters are implemented in blocks 64–71 (FIG. 2B). The first filter uses as its input the sample previously taken in block 56 and used in the calculations done for the six rate code bandpass filters described in blocks 59–61 (FIG. 2A). In block 64, 65 and 66 the low pass filter parameters are loaded, the filter routine is run and the result is operated on by the level detector to determine if it is above a specified amplitude. The parameters of this low pass filter are selected such that it spans a frequency range from zero frequency up to and just beyond the highest frequency rate code filter implemented in the system. Therefore if one of the six rate code bandpass filters is passing a signal, this first low pass filter must also be passing a signal since it covers the same frequency band. This condition verifies that the bandpass filter is capable of detecting a signal within its pass band.

In block 67 of the program the input to apparatus 50 is disabled by setting a bit in latch 35 which turns on transistor 20 via resistor 21. Transistor 20 in turn shorts the input signal passing through resistors 19 and 22 to common 42. In block 68 the input is then sampled and in blocks 69 and 70 the input signal is filtered by low pass filter LP2 and its level is tested. Low pass filter LP2 is essentially the same filter as LP1. It uses the same parameters and therefore has the same frequency response. However since its input signal is disabled, it should never indicate a signal present. This could only occur if Schmitt trigger 23 or the input circuitry of processor 33 were in oscillation. Therefore a correctly functioning system with a rate code present at its input will have the corresponding bandpass filter showing the code present, low pass filter LP1 will also show a signal present, but LP2 must not show a signal. If a signal were present at the output of LP2, this must be the result of a hardware oscillation. In block 71, the input is re-enabled by clearing the bit in latch 35 thereby turning transistor 20 off and releasing the short on the signal input.

In block 67 of the program the input to apparatus 50 will be disabled and block 68 of the program will sample the input to apparatus 50. The program proceeds to block 69 entitled "Low Pass Filter LP2" to test the filter with no input. The description of the subroutines contained in blocks 65 and 69 is described in the description of FIG. 2*d*. The next step in the program is to run the level detector routine of block 70. Then the program proceeds to block 71 to enable the sample hardware. Thus, blocks 64–71 run the low pass filter test by using the sampled input value and then with the input to apparatus 50 disabled.

In block 73 of the computer program flow chart a check sum is generated on a portion of ROM 29, and in block 74 the current count of counter 30 is read. Block 75 calculates delta T which equals the difference between the old count of counter 30 and the current count of counter 30. The value of delta T should always be a constant since it should take the same amount of time for apparatus 50 to go between the same two points of the program stored in ROM 29. Next the program proceeds to block 76 where a precalculated offset is added to delta T. Then in block 77 the program jumps to the result.

In the event the calculated value of delta T is not correct the program will jump to an address which is not going to be the proper routine and at a point in the program the proper check words would not be produced and the program would stop processing data. When data was no longer being processed the apparatus of this invention would be automatically reset by the mechanism hereinbefore described.

If the jump is made correctly, the program would proceed to block 78 entitled "Output Check Words". Block 78 is located on FIG. 2C. The check words will now be transmitted to FIFO 31 and thereafter processor 24 would be informed of the availability of the check words. The program would then proceed to block 79 where new filter constants would be inputed. At some sample, i.e., every sixteenth sample (from initial starting) a group of parameters containing state variable reset values is subtracted from the current state variables, thus performing a reset of state variables.

Block 80 is a decision block that determines if reset data is being transmitted with the new filter parameters. If reset data is being transferred the program would proceed to block 81 which would reset the filter state variables. At this point the program would proceed to block 82 entitled "Run Delay" which would execute a delay to give processor 24 time to analyze the data and return the constants required during the next program cycle. In the event no reset data is being transferred the program will proceed to block 83 entitled "Run Delay", which would execute a delay to give processor 24 time to analyze the data and return the constants required during the next program cycle. Thus, delay blocks 82 and 83 are used to equalize the time consumed between blocks 80 and 84 and to insure that the time between blocks 78 and 88 is some fixed value.

When the program completed the portion of the program represented by blocks 82 or 83 the next program step would be contained in block 84 entitled "Read Timer". The portion of the program located in block 84 would cause the count of counter 30 to be read. Next the program would proceed to block 85 entitled "Calculate Delta T" which equals new T minus old T. Block 85 will now calculate the difference between the old count of counter 30 and the new count of counter 30. Block 86 will set the old value of T to the new value of T. At this juncture the program proceeds to block 87 entitled "Add Offset to Delta T" where a calculated offset is added to delta T. Then in block 88 the program jumps to the calculated result.

If the calculated value of delta T is not correct the program will jump to an address which is not going to be the proper routine and at a point in the program the proper check word would not be produced and the program would stop processing data. If the jump is made correctly, the program would proceed to block 56 entitled "Sample Input Value on FIG. 2A" and the next sample period would begin. At this point the program should constantly loop on itself.

Figure 3:
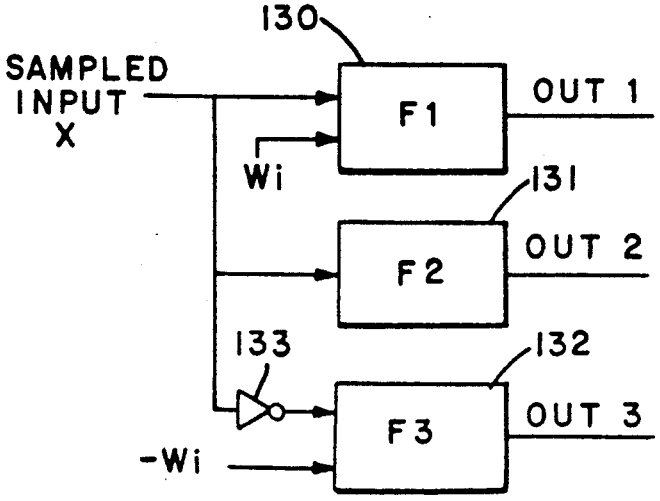
FIG. 3 illustrates a portion of the program shown in FIG. 2A–2H.
Figure 2D:
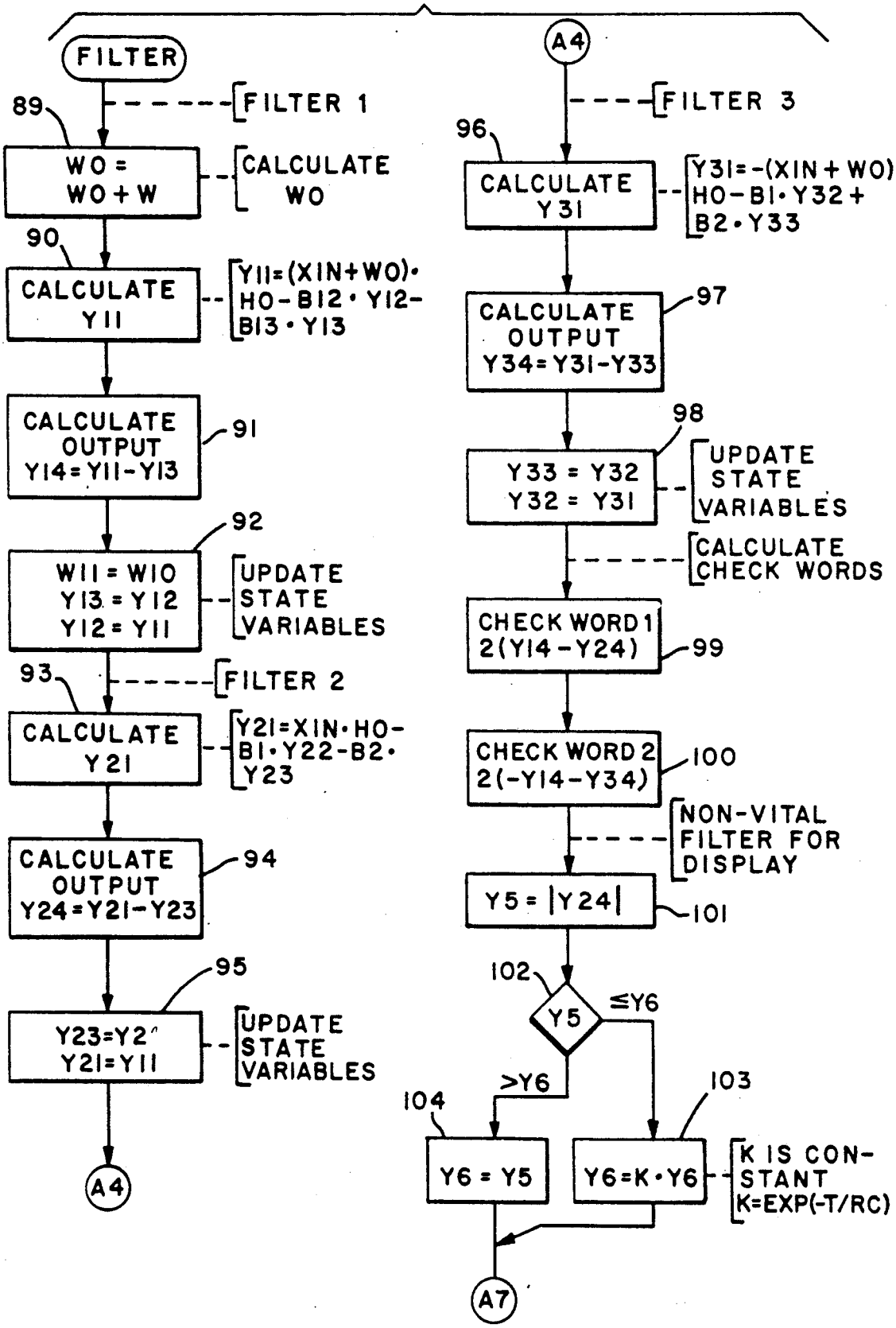
Figure 2E:
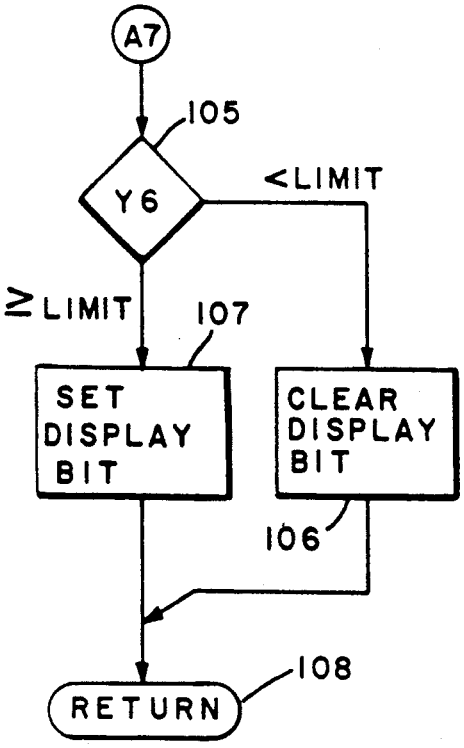

Turning now to FIG. 2D, therein is shown the computer program flow chart for the subroutine that generates the filter parameters shown in block 60 of FIG. 2D. The subroutine shown in FIG. 2D simulates three identical filters. The safety of the routine is assured by a relationship which must be maintained between the output values of the three filter routines; that is, the results of the filter calculations must always differ by a constant amount Ki. Thus, the system can only generate filter calculations that differ by an amount equal to Ki, by performing the filter calculations correctly using the correct data. This portion of the program is illustrated in FIG. 3 wherein Filter 1 is shown in box 130. Filter 2 is shown in box 131 and Filter 3 in box 132. Hence, each run through the filter loop (blocks 59–63) would produce a unique K result for each filter (K1, K2, K3, K4, K5 and K6) and $$Ki = \text{Output of filter } 1 - \text{output of filter } 2$$

$$-Ki = \text{Output of filter } 2 + \text{output of filter } 3$$

If the above Ki or −Ki results are obtained apparatus 50 is operating correctly and if the above results are not obtained apparatus 50 is malfunctioning. The difference between the filter outputs is calculated and inserted as two entries in the check word table which is transmitted to processor 24. The two check words verify that the input signal has been properly filtered but they do not verify that the output values of the filter routines are of sufficient magnitude to determine whether or not a rate code is present. This task is the function of the level detector routine which will be hereinafter described in the discussion of FIG. 2H.

The portion of the program shown in block 89 sets WO equal to the sum of W and the previous value of WO where W is a number that is transmitted to processor 24 each cycle from processor 33. Thus, WO is the running sum of the numbers W. In block 90 Y11 is calculated as $Y11 = (XIN + WO) \cdot HO - B12 \cdot Y12 - B1\text{-}3 \cdot Y13$ wherein B1 and B2 are the filter coefficients which determine the frequency response of the filter, HO is a scaling constant, XIN is the latest value of the sampled input, WO is the running sum of the values W, and Y12 and Y13 are the state variables for the first of the three filters to be calculated. The program proceeds to block 91 where the output from filter one, Y14, is calculated by subtracting Y13 from Y11. Next in block 92, the state variables are updated. Y13 is set to the value contained in Y12 and Y12 is then set equal to Y11. In the foregoing discussion variables are coded Y11, Y12, Y13, Y14. The first number in the variable name represents the filter number (F1, F2, F3) and the second number represents the number of the variable for that filter.

At this point, the program begins to perform the calculations for filter 2(F2). In block 93, Y21 is calculated as $Y21 = XIN \cdot HO - B1 \cdot Y22 - B2 \cdot Y23$, where B1 and B2 are the same filter coefficients. XIN is the same value of the sampled input, and HO is the same scaling constant used in filter 1, and Y22 and Y23 are the state variables of filter 2. In block 94, the output of filter 2 is calculated as $Y24 = Y21 - Y23$, and in block 95 the state variables are updated by setting $Y23 = Y22$ and $Y22 = Y21$ in sequence. It is noted that filter 2 uses the same coefficients and input variable as filter 1, but it does not use WO. Therefore, the difference between the outputs of filter 1 and filter 2 will be a result of the effects of the additional value WO used in filter 1.

The program proceeds to block 96, the variable Y13 of filter 3 is calculated as $Y31 = -(XIN + WO) \cdot HO - B\text{-}1 \cdot Y32 - 32 \cdot Y33$, where XIN, WO, B1 and B2 are the same numbers used in filter 1 with the exception that XIN and WO are negated in this equation. The next step of the program appears in block 97, where the output of filter 3 is calculated as $Y34 = Y31 - Y33$, and in block 98, the state variables are in turn updated as $Y33 = Y32$ and $Y32 = Y31$. Since the calculations for filter 3 are essentially the same as those for filter 1 with the exception that the inputs XIN and WO are negated, the output of filter 3 will be the negtive of the output from filter 1.

In block 99, the first check word on the process is formed by taking the difference between Y14 and Y24 and multiplying it by 2. Since Y14 differs from Y24 only in the effect of the input WO, this difference will represent the effect of the input WO upon filter 1. Similarly in block 100 the second check word is calculated as twice the difference of the negative of the output from filter 2, Y24, and the output from filter 3, Y34. Since Y34 is the negative of Y14, the second check word will be essentially the same as the first calculated in block 99.

The remainder of the filter routine involves a non-vital calculation used for display purposes only. In block 101 Y5 is set equal to the absolute value of the output from filter 2, i.e. Y24. Decision block 102 determines if Y5 is greater than Y6. If it is, Y6 is replaced with the value of Y5 in block 104, and if it is not in block 103, Y6 is multiplied by a constant K which is less than one. Therefore if a code rate is not being received, and Y5 is always less than Y6, Y6 will repeatedly be multiplied by a number less than one and will gradually approach zero. The rate at which this occurs depends upon how close K is to one. Therefore this calculation approximates a simple peak detector in that whenever Y5 is greater than Y6, Y6 will follow Y5, but when Y5 is less than Y6, Y6 decays slowly with time.

The program advances to decision block 105 (FIG. 2E) where Y6 is compared against a threshold limit. If Y6 is less than that limit, the display indicator for the rate code is turned off in block 106 and if it is not the display is turned on in block 107. Thus whenever the output from filter 2 is greater than the designated limit, the display indicator for the filter is turned on. A return occur in block 108 and the program goes back to block 61.

In the filter subroutine the sampled input value X is applied as an input to three bi-quadratic digital filter sections F1, F2, and F3. Each section performs essentially the same calculation which results in a function with the frequency response of a two pole band pass filter having a roll off of 20 db per decade. The center frequency and Q of the filter are functions of the sample rate of the system and the two filter coefficients B1 and B2. Therefore, in order to guarantee the safety of the system, the following items must be verified. First that the calculation was performed correctly. Second that the correct coefficients were used. Third, that the sample rate was correct. Fourth that the sampled input value X was within specified limits and that it did indeed represent the input voltage to the system at the particular time and not some fault condition in the input circuitry.

The algorithm performed by the three filter sections F1, F2, and F3 are basically the same, but the input data to each section is different. This portion of the program is illustrated in FIG. 3, wherein filter 1 is shown in box 130, filter 2 in box 131 and filter 3 in box 132. The sampled input XIN is inversed to −XIN by inverter 133. F1 has two inputs, XIN and W; F2 has only one input XIN, and F3 has two inputs, −XIN and −W. In view of the fact that the algorithm used in all three filter sections is essentially the same, in the following discussion the variable names will be shortened to Y1, Y2, Y3 and Y4 and the context will indicate which filter (F1, F2 or F3) is being discussed.

There are only two types of calculation in the above algorithm, multiplication and addition. A running sum W0 is kept of the input sequence W by adding the old value of the running sum WO to the latest input value W. The sample input XIN is added to the running sum W0 and the resulting sum is multiplied by the scaling factor H0. The scaling factor H0 is needed to compensate for a gain which is inherent in the filter calculations. It is usually selected to be a power of two, and therefore will be implemented with a shift operation. This result is then summed with the products of the filter coefficients B1 and B2 and the corresponding filter state variables Y2 and Y3. The result of this summation is Y1. The filter output Y1 is calculated as the difference between Y1 and Y3. The filter state variables must now be updated to prepare for the following sample period. This is done by overwriting Y3 with the previous value stored in Y2 then Y2 with the result calculated as Y1. Therefore in order to implement the filter, four summations, one shift and two multiplies are required.

The input sequence W is applied as an input to filter sections F1 and F3 but not to F2. The reason for this is that the digital filter calculation is linear, and the summation of the inputs XIN and W does not effect the frequency response for the filter to either signal. In other words, the input signal XIN is filtered exactly the same whether or not W is present, and W is filtered exactly the same whether or not X is present. The only result of the addition of the input signals W and X is to produce at the filter output the summation of the filter response to each input signal taken individually. Since XIN is applied as an input to all three filters and since W is applied to only two of the three filters, the differences between the filter outputs are determined by the response of the filters to W. The initial value is Ki/HO which is followed at the next sample time by KiBl/HO and then by Ki(1+B2)/HO. As indicated, from that point on, the second and third input values of W are alternated as long as desired. The sequence W is selected because when it is applied as an input to the filter characterized by HO, B1, B2 a constant output Ki results. The above may be verified by assuming that the input XIN is held at 0 and that the state variables Y2 and Y3 are initialized to 0 and then by applying the sequence W as the sole input in calculating the output Y. This calculation is performed for the first five values of the sequence W in the following table:

| W | WO | Y1 | Y2 | Y3 | Y4 |
|---|---|---|---|---|---|
| Ki/HO | Ki/HO | Ki | 0 | 0 | Ki |
| KiB1/HO | Ki(1 + B1)/HO | Ki | Ki | 0 | Ki |
| Ki(1 + B2)HO | Ki(2 + B1 + B2)/HO | 2Ki | Ki | Ki | Ki |
| KiB1/HO | Ki(2 + 2B1 + B2)/HO | 2Ki | 2Ki | Ki | Ki |
| Ki(1 + B2)HO | Ki(3 + 2B1 + 2B2)/HO | 3Ki | 2Ki | 2Ki | Ki |

Therefore, the result of using this specific sequence W is to produce an output which consists of the filtered input signal XIN summed with a constant value Ki. Since W is not used in filter F2 its output is simply the filtered input signal XIN. Therefore, so long as the correct sequence of input values is applied to the W input of F1, the outputs of F1 and F2 will differ by a constant Ki. Since the inputs to F3 are negated (−XIN−W) the sum of outputs from F2 and F3 differ at all times by a constant value −Ki. The input values W are functions of Ki, B1, B2 and H0, but they need not be calculated each time. The aforementioned input values are the data that is passed each cycle from processor 33 to processor 24 to permit processor 24 to continue to function. The above values provide the control which processor 33 has over processor 24. In this manner there is no obvious relationship between the sequence of inputs W and the desired output relationship and the fixed offset Ki. Thus, the Ki's are obtained by calculating them to verify that the calculations are done correctly. Hence, there is virtually no possibility that apparatus 50 could somehow select the desired output relationship without performing the desired calculation.

The foregoing arrangement provides a check on three things. First, each filter must run each cycle and must run correctly in order to maintain the correct offset. Second, each filter must use its correct set of coefficients and state variables i.e., B1, B2, Y2, Y3, because if an incorrect value is used for any of these items, the desired output relationship is lost. The foregoing is true since the state variables are a record of the previous input values and coefficients used in the filter calculations. Therefore, if one or more incorrect state variables or coefficents are erroneously selected for a calculation, the desired offset relationship is destroyed. Furthermore, since the state variables maintain a memory of previous inputs, the relationship is lost for all subsequent values. However, if the wrong set of inputs W were applied to a filter using its correct state variables and coefficients, the offset relationship would be destroyed since the relationship between the filter state variables and coefficients and the input sequence W must be maintained in order to produce the desired offset between the outputs. Even if the wrong set of coefficients, state variables, and W inputs were used in the wrong filter, the error would be detected because a different offset value Ki would be used for each one of the six filters. The result would be the wrong offset Ki for the resulting filter. Thirdly, the scaling of the input value XIN is guaranteed by the above arrangement. The danger here is that if the input is not properly prescaled, the resulting output would appear greatly amplified. This result would be disasterous for the level detection subroutine described in FIG. 2*d*. The reason for this is that the W and XIN inputs are summed before scaling, thus, the sequence of W constants all contain a factor 1/H0. Hence, the resulting sum is properly scaled to compensate for the prescaling in the W input sequence.

One further check on the correctness of the calculations is the use of the third filter F3 which produces essentially the same result as F1 but with an inverted sign. This function is included primarily for use in the level detector subroutine discussed in the description of FIG. 2*d*. In order to produce a constant output value Ki, the running sum W0 and the state variables Y2 and Y3 will continually increase in magnitude with time. This is equivalent to producing a constant output from an analog band pass filter by applying a ramping input signal which will eventually overload the filter in some manner. Therefore, if untouched for sufficient time, the system will overflow and being producing false outputs. In order to prevent the foregoing, periodically variables W0, Y2, Y3 must be reset. Because the filters are linear, the ramping effect on each filter F1, F3 is independent of the present or past history of the input variable XIN. Therefore, assuming that each variable starts from zero, after a fixed number of cycles, each variable will have ramped up or down to a value which can be easily calculated from the known input sequence W. For example, if the input variable X is zero, the digital filter will work in terms of differences and the state variables can all be reset to zero at any point in time by subtracting a constant value from each state variable without effecting the overall operation of the filter. In this manner, overflow can be avoided and a further check can be made on the operation of the filter. The constants which must be subtracted from each state variable are a function of H0, B1, B2, Ki and therefore are unique to each filter. Obviously the number of cycles between resets also effects the constants values. Thus, the reset must occur before overflow.

The foregoing description described a single two pole band pass filter. The total filter algorithm consists of three nearly identical two pole band pass filters operating in parallel, wherein the outputs of all of the filters are maintained at a fixed relationship in order to verify that they are operating properly.

Figure 2F:
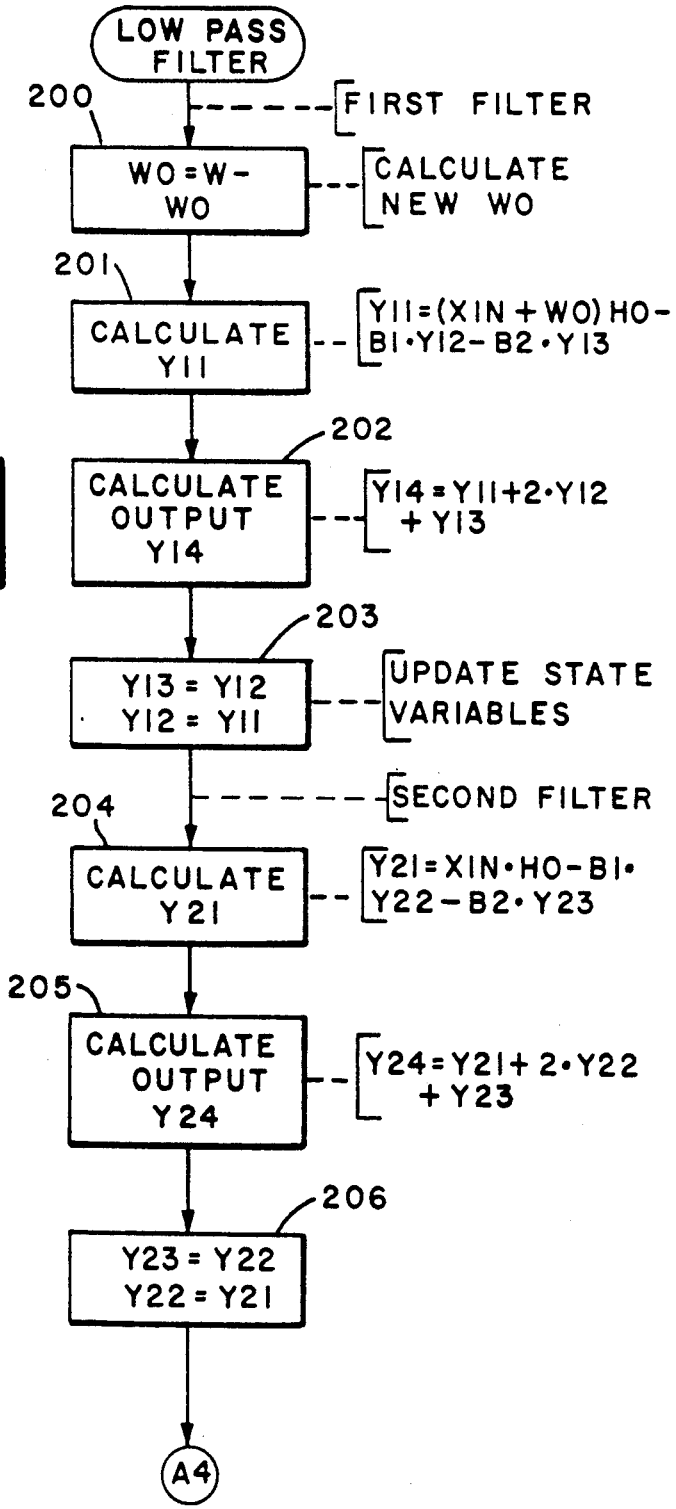

Turning now to FIG. 2F, the operation of the low pass filter routines represented by blocks 65 and 69 will be described in greater detail. The portion of the program shown in block 200 sets WO=W−WO where W represents a series of constants that are transmitted each cycle from processor 33 to processor 24. In block 201 Y11 is calculated as Y11=(XIN+WO)·HO−B1·Y12−B2·Y13, where B1 and B2 are the filter coefficients which determine the frequency response of the filter. HO is a scaling constant. XIN is the latest value of the sampled input. WO is the value calculated in block 200 and Y12 and Y13 are the state variables for the first of the three filters to be calculated. In block 202 the output from filter one, Y14, is calculated, Y14=Y11+2·Y12·Y13. In block 203, the state variables are updated, Y13 is set to equal the value contained in Y12 and Y12 is then set to Y11.

At this point the program begins to perform the calculations for filter 2(F2). In block 204, Y21 is calculated as Y21=XIN·HO−B1·Y22−B2·Y23, where B1 and B2 are the same filter coefficients, XIN is the same value of the sampled input, and HO is the same scaling constant used in filter 1 and Y22 and Y23 are the state variables of filter 2. In block 205, the output of filter 2 is calculated as Y24=Y21+2·Y22+Y23 and in block 206 the state variables are sequencially updated by first setting Y23=Y22 and then setting Y22=Y21. It is to be noted that filter 2 uses the same coefficients and input variable a filter 1, but it does not use WO. Therefore, the difference between the outputs of filter 1 and 2 will be a result of the effects of the additional value WO used in filter 1.

Figure 2G:
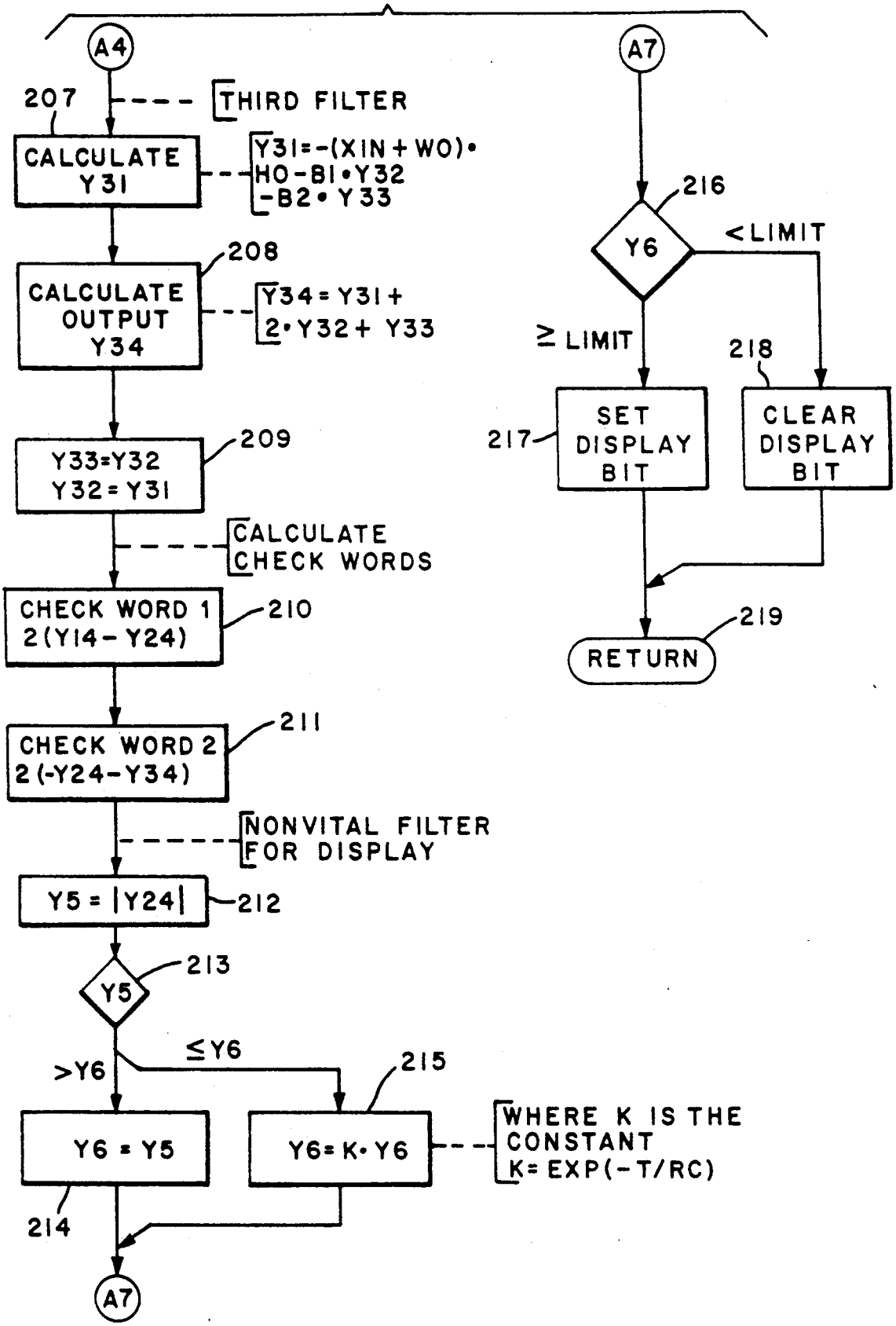

The next step of the program is contained in block 207 (FIG. 2G). Wherein the variable Y13 of filter 3 is calculated as Y31=−(XIN+WO)·HO−B1·Y32−B2·Y33, where XIN, WO, B1 and B2 are the same numbers used in filter 1 with the exception that XIN and WO are negated in this equation. In block 208, the output of filter 3 is calculated as Y34=Y31+2·Y32+Y33, and in block 209, the state variables are in turn updated as Y33=Y32 and Y32=Y31. In view of the fact that the calculations for filter 3 are essentially the same as those for filter 1 (with the exception that the inputs XIN and WO are negated, the output of filter 3 will be the negative of the output from filter 1.

In block 210, the first check word is developed by taking the difference between Y14 and Y24 and multiplying that result by 2. Y14 will differ from Y24 only in the effect of the input WO, thus this difference will represent the effect of the input WO upon filter 1. Similarly in block 211 the second check word is calculated as twice the difference of the negative of the output from filter 2, Y24, and the output from filter 3, Y34. Since Y34 is the negative of Y14, the second check word will be essentially the same as the first calculated in block 210.

The remainder of the filter routine involves a nonvital calculation that is used for display purposes. In block 212, Y5 is set equal to the absolute value of the output from filter 2, Y24. At this point, decision block 213 determines if Y5 is greater than Y6. If it is, Y6 is replaced with the value of Y5 in block 214 and if it is not in block 215 Y6 is multiplied by a constant K which is less than one.

Therefore if a code rate is not being received, and Y5 is always less than Y6, Y6 will repeatedly be multiplied by a number less than one and will gradually approach zero. The rate at which this occurs depends upon how close K is to one. Therefore, this calculation approximates a simple peak detector in that whenever Y5 is greater than Y6, Y6 will follow Y5, but when Y5 is less than Y6, Y6 decays slowly with time.

At this juncture in decision block 216, Y6 is compared against a threshold limit. If it is less than the above limit, the display indicator for the rate code is turned off in block 218 and if it is greater than that limit it is turned on in block 219. Thus, whenever the output from filter 2 is greater than the designated limit, the display indicator for the filter is turned on. A return occurs in block 219 and the program goes back either to block 66 or 70 of FIG. 2*a* depending upon the point of entry.

Figure 2H:
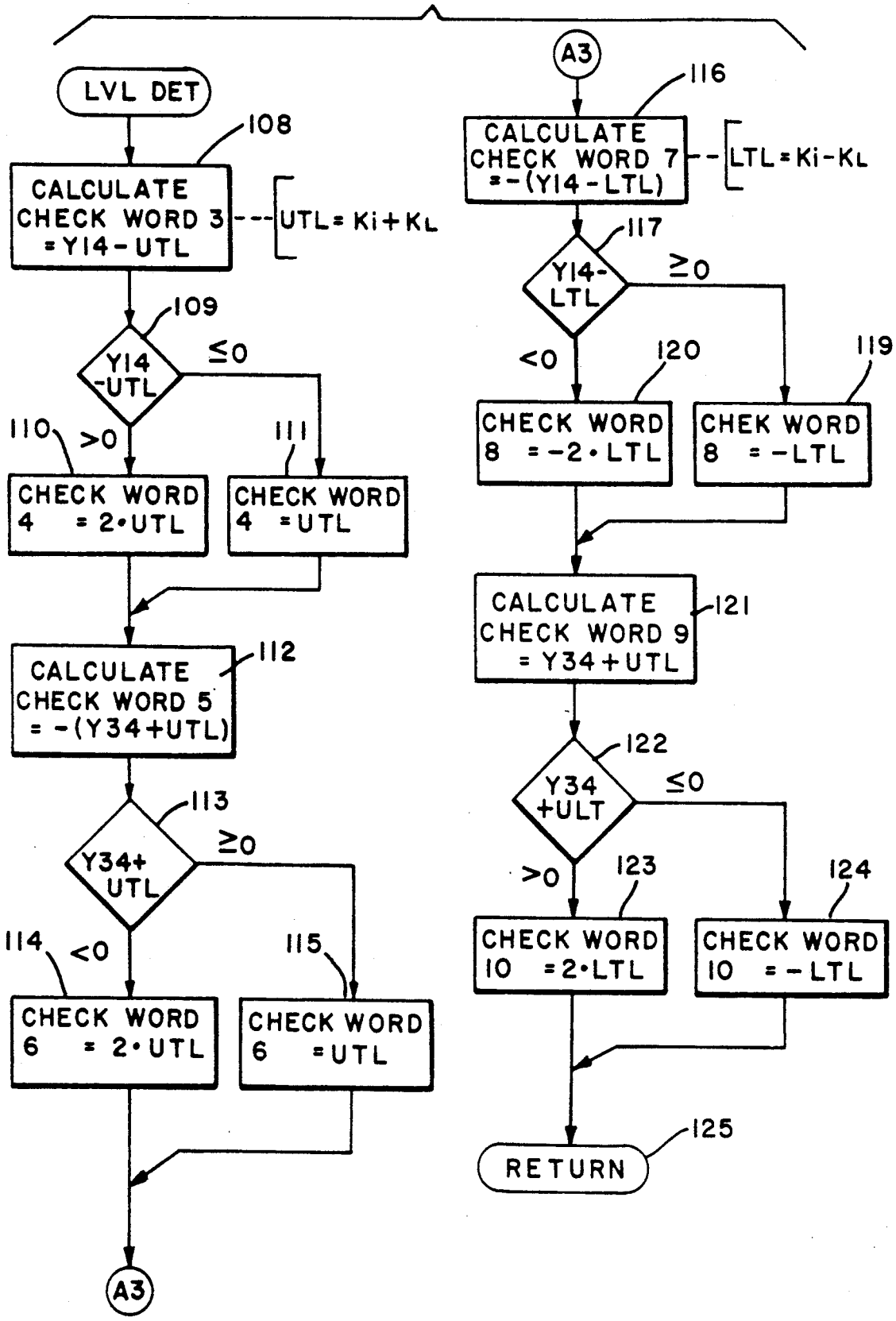

Turning now to FIG. 2H, therein is shown the program flow chart for the subroutine that generates the level detector routine which is applied to blocks 61, 66 and 70 of FIGS. 2A and 2B.

The level detector subroutine shown in FIG. 2H is performed to insure that the amplitude of the filter output signals exceed some predetermined level. This is done to determine whether or not a rate code i.e., maximum speed signal is being received at the output of filter 17 (FIG. 1). If a valid rate code is present at the input to filter 1 (F1), filter 2 (F2) and filter 3 (F3), Y14, Y24 and Y34 are the outputs of F1, F2 and F3 respectively. An upper and a lower threshold level UTL and LTL are set such that a valid rate code will cause the filter outputs to alternately exceed first one and then the other. UTL is equal to Ki plus K1 and LTL is equal to Ki−K1 where K1 is 0.707 times the maximum swing of the filter output signal. (Ki represents one of the six offset constants K1, K2, K3, K4, K5 and K6 calculated in the filter routines hereinbefore described). The maximum output swing is determinable from the fact that the input signal is limited to the range from plus one to minus one. It occurs when the input to the filter is a square wave at the filter's center frequency. K1 is set to 0.707 of the maximum output in order to limit the detection of a signal to within the three db points of the filter response.

Ki would normally be chosen to be large in comparison to the maximum amplitude swing of any filter output so that widely differing values of Ki can be selected for each filter.

The level detector subroutine performs a series of comparisons between UTL and LTL the outputs from both F1 and F3. Each result is placed in the check word table as a check word, and depending upon the sign of that result a second word is placed in the table. The second check word generated in each test is a function of the threshold level used in the previous test in order to insure that the correct threshold levels are used in the calculations. The resulting check word table is then processed in a manner to determine whether the filter output has exceeded either threshold level or is between threshold levels.

In the following discussion the equalities apply:

$$Y14 = Y24 + Ki$$

$$Y34 = -Y24 - Ki$$

$$UTL = Ki + Kl$$

$$LTL = Ki - Kl.$$

The first test is to subtract UTL from Y14, the output from filter Fl, and to place that result in check word 3. If the filter operation has been correct, Y14 is equal to Y24+Ki, and since UTL equals Ki+Kl, the result of the calculation is Y24−Kl. If the result is greater than zero, indicating that Y14 is greater than UTL, check word 4 is set to 2·UTL, and otherwise it is set to UTL.

Next a second check is made using UTL and Y34. The sum of UTL and Y34 is formed. Check word 5 is set to the negative of this sum. If UTL+Y34 is less than zero, indicating that Y34 is more negative than −UTL, then check word 6 is set to −2·UTL and otherwise it is set to −UTL.

Similarly Y14 and Y34 are compared against LTL to determine if the filter output is below the lower threshold level. Check word 7 is set to −(Y14−LTL), and if (Y14−LTL) is negative, check word 8 is set to −2·LTL and otherwise it is set to −LTL. Lastly check word 9 is set to Y34+LTL, and if Y34+LTL is greater than zero, check word 10 is set to −2·LTL otherwise it is set to −LTL.

The entries in the following checkword table for a single filter are grouped into a group of terms which are constants (1, 2, 3, 5 7, 9) and a group of terms (4, 6, 8 and 10) which vary depending upon the amplitude of the filter output signal. The sum of the first group is:

$$\text{Sum } 1 = 4Ki - 4Kl.$$

The sum of the remaining terms (4, 6, 8 and 10) are determined by the signal amplitude. There are four terms with two possible choices per term and thus there are sixteen possible combinations. Only three of these possible combinations are valid.

| Case | Output |
|---|---|
| C1 | 2Ki+6K1 |
| C2 | −2Ki+6K1 |
| C3 | 4Ki |

Cl corresponds to the case where the signal exceeds the upper threshold level. C2 to the case where the signal is below the lower threshold level, and C3 to the case where the signal is between the two threshold levels. The remaining thirteen combinations correspond to contradictory results, and they can be partitioned into six separate cases.

| Case | Output |
|---|---|
| C4 | 8K1 |
| C5 | −Ki+7K1 |
| C6 | Ki+7K1 |
| C7 | 6K1 |
| C8 | Ki+5K1 |
| C9 | −Ki+5K1 |

Therefore, a restriction on the choice of Ki and Kl is that they be chosen such that cases C1 to C3 are distinguishable from C4 to C9.

Finally, in order to determine the state of the output signal, the check sum table is summed and an offset is added to this result. The offset value is:

$$\text{Offset} = -4Ki + 2Kl.$$

Performing this calculation on the three valid cases results in the following valid results:

2Ki for case Cl (Y24>Kl)

−2Ki for case C2 (Y24<−Kl)

−2Kl for case C3 (−Kl≦Y24≦Kl).

Therefore the complete calculation simplifies to three valid results for each filter/level detector combination. If the filter output signal is greater than the selected reference level the output is 2Ki where Ki is a constant value characteristic of the filter being performed. If the output signal is less than −Kl, the result of the calculation is −2Ki and if the value exceeds neither level the output is −2Kl, the level against which the test is being made. Neither Ki nor Kl is stored permanently in the memory and must therefore be produced as the result of the filter/level detector calculations performed in this subroutine. The final result of the complete algorithm then is for each filter/level detector which is not presently detecting a code rate i.e., maximum speed signal, the output remains a constant value −2Kl, where Kl would be a different value for each filter/level detector in the system. For each filter detecting a code rate, the output would appear in the following sequence:

2Ki, 2Kik . . . 2Ki, −2Kl−2Kl . . . −2Kl, −2ki,
−2Ki, . . . −2Ki, −2Kl, −2Kl, . . . −2Kl

The duration of a particular constant at the output of apparatus 50 would depend upon a number of factors: The sample rate; the input signal amplitude; the amount of noise present; and the value of Kl. The output would continue in the indicated sequence which would be periodic at the code rate i.e., maximum speed signal. If the output of apparatus 50 is a modified version of the system input, the question arises as to what has been gained by the foregoing process. The answer is two things. The output in the form of a sequence of alternating constants Ki, −Ki will only be present if the system input signal contains a frequency component within the pass band of one of the filters implemented by the system. Secondly, the process of squaring the input signal into a binary signal has the effect of throwing away all of the information in the incoming signal except that portion of the signal contained in the zero crossings. This process introduces harmonics of the frequencies contained in the incoming signal. The filter/level detector process insures that the system will not react to these generated harmonics because their amplitude will be below the detection level in the worse case. As indicated above each filter implementation in the system has unique values of Ki and Kl. These values would be passed from the processor 24. For a situation in which six code rates i.e. six maximum speed signals are being used the list would contain six words. Each word in the list should have the value Kl, Ki or −Ki corresponding to each filter.

If no code rate is active the list should consist of the values of Kl corresponding to each filter. Otherwise, apparatus 50 is malfunctioning. If one of the list entries changes to its corresponding Ki or −Ki values that code rate i.e., maximum speed signal is being detected, and this event can be interpreted as a go condition which is valid for slightly longer than one half of the period corresponding to that code rate i.e., maximum speed signal. If the alternating value is not received within the corresponding time period, the go condition must be terminated. If the alternating value is received within the time period, the go condition is extended for another half cycle period. As long as alternating values of Ki, −Ki are received within the alloted time period, the rate code can be considered to be valid.

CHECK WORD TABLE FOR A SINGLE FILTER

| Check Word No. | |
|---|---|
| 1 | 2Ki |
| 2 | 2Ki |
| 3 | Y24-KL |
| 4 | 2(Ki+k1) or (Ki+K1) |
| 5 | Y24−KL |
| 6 | 2 (Ki + K1) or (Ki + K1) |
| 7 | −Y24−KL |
| 8 | −2(Ki−K1) or −(Ki−K1) |
| 9 | −Y24−KL |
| 10 | −2(Ki−K1) or −(Ki−K1) |

In FIG. 2H block 108, check word 3 is formed by subtracting UTL from Y14, the output from filter Fl. If the filter has operated correctly, the following equality should hold, Y14=Y24+Ki. Since UTL=Ki+Kl, Y14=UTL will equal Y24=Kl. Decision block 109 tests the calculated result Y14−LTL. If Y14−UTL is greater than zero, indicating that Y14 is more positive than UTL, check word 4 is set to 2·UTL in block 110, and otherwise it is set to UTL in block 111. Next in block 112, check word 5 is formed as −(Y34+UTL) where Y34 is the output from filter F3. Because Y34 will equal −Y24−Ki when the filters operate correctly, and because UTL=Ki+Kl, check word 5 will be Y24−Kl. In decision block 113, the result Y34+UTL is tested. If Y34+UTL is less than zero, indicating that Y34 is more negative than −UTL, than check word 6 is set to 2·UTL in block 114, and otherwise it is set to UTL in block 115. Next check word 7 is calculated as −(Y14−LTL) in block 116. Decision block 117 tests Y14−LTL. If Y14−LTL is less than zero, indicating that Y14 is less then LTL, then check word 8 is set to −2·LTL in block 120, and otherwise it is set to −LTL in block 19. In block 121 check word 9 is calculated as Y34+LTL. If Y34+LTL. If Y34+LTL is greater than zero indicating that Y34 is less negative than −LTL, than check word 1010 is set to −2·LTL in block 123, and otherwise it is set to −LTL in block 124. A return is taken in block 125 which returns the program flow to either block 62, 67 or 71 in FIG. 2*a* depending upon the point from which the level detector routine was entered.

What is claimed is:

1. In a railway signaling system in which rate code signals are propagated along rails, a vital digital system that decodes a plurality of different allowable rate code (speed) signals and receives vehicle parameters in order to specify a maximum safe speed that a railway vehicle can travel at different times along the rails, said system comprising:

(a) means on the railway vehicle which are coupled to said rails for detecting said rate code signals and providing output signals corresponding thereto;

(b) vital processing means operative in fixed cycles and responsive to said output signals for detecting said rate code signals, said processing means comprising computer means for simulating a plurality of digital filters for decoding said output signals and providing digital signals corresponding to the frequency differences therebetween;

(c) said vital processing means comprising means responsive to said digital signals for making a multiplicity of calculations thereon during each cycle for detecting whether said calculations are performed in certain sequence and said rate code signals are valid and for providing control signals said vehicle indicative of an unsafe condition when the absence of an allowable rate signal is not detected; and wherein said processing means provides said digital filters as infinite impulse response filters having outputs which will always differ by a constant magnitude and verifies that said output signals correspond to said allowable rate code signals and said digital filters are vital in operation.

2. A method of operating a vital digital decoder that decodes a plurality of different allowable rate code, safe speed signals, each of which is in a different permissible frequency range, in order to specify a maximum safe speed that a vehicle may travel at different times comprising the steps of:

(a) receiving said rate code signals on a railway vehicle that travels along the rails of a railway track;

(b) scanning during a plurality of repetitive fixed cycles said rate code signals and detecting the frequencies thereof by filtering said signals with the aide of digital filters thereby providing filtered signals;

(c) detecting a plurality of times during each of said fixed cycles if the differences between said frequencies are within certain ranges thereby determining if any of the filtered signals lies within one of the permissible frequency ranges that correspond to an allowable safe speed and is vital; and (d) inidcating an unsafe signal when any of said differences is not within said certain ranges and is not vital;

wherein said filtering step is carried out by executing a plurality of infinite impulse digital filter calculations, and said indicating steps is carried out by indicating whether said calculations result in output values which differ by a constant magnitude.

3. The method according to claim 2 further comprising the steps of detecting the amplitudes of said filtered signals to determine if the output of the filtered signal corresponding to the maximum safe speed is above a predetermined level and is indicative that a valid maximum rate code signal is being received by said vehicle.

4. In a railway signaling system in which rate code signals are propagated along rails, a vital digital system that decodes a plurality of different allowable rate code (speed) signals and receives vehicle parameters in order to specify a maximum safe speed that a railway vehicle can travel at different times along the rails said system comprising:

(a) means on the railway vehicle which are coupled to said rails for detecting said rate code signals and providing output signals corresponding thereto:

(b) vital processing means operative in fixed cycles and responsive to said output signals for detecting said rate code signals, said processing means comprising computer means for simulating a plurality of digital filters for decoding said output signals and providing digital signals corresponding to the frequency differences therebetween;

(c) said vital processing means comprising means responsive to said digital signals for making a multiplicity of calculations thereon during each cycle for detecting whether said calculations are performed in certain sequence and said rate code signals are valid and for providing control signals to said vehicle indicative of an unsafe condition when the absence of an allowable rate signal is not detected;

(d) testing means whose inputs are coupled to the outputs of said processing means and whose output is coupled to the input of said processing means for testing said processing means by shorting the output of said detecting means to determine if said digital signals correspond to a false oscillation indicative of one of said allowable rate code signals and said system is not in a vital state; and wherein said testing means comprises:

a. a first resistor one end of which is coupled to the output of said detecting means;

b. a NPN transistor whose collector is coupled to the other end of said first resistor;

c. a second resistor one end of which is coupled to the end of said first resistor and the collector of said transistor;

d. a third resistor one end of which is coupled to the output of said detecting means and the other end of which is coupled to the emitter of said transistor;

e. a fourth resistor one end of which is coupled to the base of said transistor and the other end of which is coupled to ground;

f. a Schmidt trigger that detects the voltage level of the output of said output signals provided by said detecting means, the input of said trigger is coupled to the other end of said second resistor, and the output of said trigger is coupled to the input of said processing means;

g. a fifth resistor one end of which is coupled to the base of said transistor, and the other end of which is coupled to the output of said processing means; and whereby when said processing means transmits a signal to said fifth resistor a test will begin by said NPN transistor causing the output of said detecting means to be shorted to ground so that said trigger will not transmit a signal to said processing means and said processing means will determine whether or not it is processing a signal at this time wherein if said processing means was not processing detecting a valid signal at this time the input circuitry of said processing means and said trigger would not be oscillating at a frequency which corresponds to one of said allowable signals, thereby falsely showing an impermissible speed limit and said processing means would end the test by removing the signal transmitted to said fifth resistor causing said NPN transistor to be turned off allowing said processor to receive the output of said detecting means.

5. The system claimed in claim 4 further including latching means whose input is coupled to the output of said processing means and whose output is coupled to one end of said fifth resistor for transmitting the output of said processing means to the input of said testing means in order to begin a test.

6. The system claimed in claim 5 wherein said latching means is a plurality of flip-flops.

7. In a railway signaling system in which rate code signals are propagated along rails, a vital digital system that decodes a plurality of different allowable rate code (speed) signals and receives vehicle parameters in order to specify a maximum safe speed that a railway vehicle can travel at different times along the rails said system comprising:

(a) means on the railway vehicle which are coupled to said rails for detecting said rate code signals and providing output signals corresponding thereto:

(b) vital processing means operative in fixed cycles and responsive to said output signals for detecting said rate code signals, said processing means comprising computer means for simulating a plurality of digital filters for decoding said output signals and providing digital signals corresponding to the frequency differences therebetween;

(c) said vital processing means comprising means responsive to said digital signals for making a multiplicity of calculations thereon during each cycle for detecting whether said calculations are performed in certain sequence and said rate code signals are valid and for providing control signals to said vehicle indicative of an unsafe condition when the absence of an allowable rate signal is not detected;

(d) testing means whose inputs are coupled to the outputs of said processing means and whose output is coupled to the input of said processing means for testing said processing means by shorting the output of said detecting means to determine if said digital signals correspond to a false oscillation indicative of one of said allowable rate code signals and said system is not in a vital state; and wherein said processing means comprises:

a. a first memory that contains a decoding program that is used in decoding said output signals to provide said digital signals and verifying that at least one of said digital signals is equal to one of said allowable rate code signals;

b. said computer means comprising a microprocessor whose inputs are coupled to the outputs of said testing means and said first memory, said microprocessor processes said rate code signals in accordance with the program stored in said first memory;

c. a second memory whose input is coupled to the output of said microprocessor, and whose output is coupled to the input of said microprocessor, said second memory temporarily stores the output of said microprocessor;

d. a first, first-in, first-out memory, whose input is coupled to the output of said microprocessor, and whose output is coupled to a cab processor, said first memory temporarily storing information that represents the maximum safe speed that said vehicle may travel at a given time and then transmits that information to a cab processor;

e. a second, first-in, first-out memory, whose input is coupled to the output of said cab processor and whose output is coupled to the input of said microprocessor, said second memory temporarily stores information that is transmitted to said microprocessor from said cab processor; and f. timing means coupled to the inputs of said microprocessor for providing an independent time reference to said microprocessor.

8. The system claimed in claim 7 wherein said first memory is a read only memory.

9. The system claimed in claim 7 wherein said second memory is a random access memory.

10. The system claimed in claim 9 wherein said timing means comprises:

a. a first clock coupled to the input of said microprocessor for timing the operations performed by said microprocessor;

b. a second clock that outputs a clock pulse;

c. a counter whose input is coupled to the output of said second clock, and whose output is coupled to the input of said microprocessor, said counter is periodically read by said microprocessor to verify that the difference between the readings of said counter is a fixed number; and d. address decoding logic whose input is coupled to the output of said microprocessor and whose outputs are coupled to said first and second memories, said first and second first in first out memories, said latching means and said counter for decoding the address outputted by said microprocessor.

11. The system claimed in claim 7 further including indicating means whose input is coupled to the output of said microprocessor, for indicating the value of the currently decoded maximum speed signal.

12. The system claimed in claim 11 wherein said indicating means comprises:

a. latching means whose input is coupled to the output of said microprocessor said latching means temporarily stores information, and b. display means coupled to the output of said latching means for displaying the value of the currently decoded maximum speed signal.

13. The system claimed in claim 12 wherein said latching means comprises: a plurality of flip-flops.

14. The system claimed in claim 12 wherein said display means comprises a plurality of light emitting diodes.

15. The system claimed in claim 7 further including a scratch pad memory contained within said microprocessor to enable said microprocessor to perform faster calculations.

16. The system claimed in claim 7 further including a watch dog timer whose input is coupled to the output of said latching means, and whose output is coupled to the input of said microprocessor, and watch dog timer resets said microprocessor when said microprocessor malfunctions.

17. A method of operating a vital digital decoder that decodes a plurality of different allowable rate code, safe speed signals, each of which is in a different permissible frequency range, in order to specify a maximum safe speed that a vehicle may travel at different times comprising the steps of:

(a) receiving said rate code signals on a railway vehicle that travels along the rails of a railway track;

(b) scanning during a plurality of repetitive fixed cycles said rate code signals and detecting the frequencies thereof by filtering said signals with the aide of digital filters thereby providing filtered signals;

(c) detecting a plurality of times during each of said fixed cycles if the differences between said frequencies are within certain ranges thereby determining if any of the filtered signals lies within one of the permissible frequency ranges that correspond to an allowable safe speed and is vital;

(d) indicating an unsafe signal when any of said differences is not within said certain ranges and is not vital;

(e) said filtering step further including the step of performing three simultaneous linear filtering operations on the maximum safe speed signal; and wherein said three simultaneous linear filtering operations further include the steps of:

linearly filtering the maximum speed signal which constitutes the first simultaneous linear filtering operation;

integrating a series of constants (W);

summing said constants with the maximum speed signal;

linearly filtering said integrated constants and said maximum speed signal to complete the second simultaneous linear filtering operation;

integrating a series of constants (−W);

summing said (−W) constants with the negative of the maximum speed signal;

linearly filtering said (−W) integrated constants and said negative maximum speed signal to complete the third simultaneous linear filtering operation;

whereby the difference in the output of said first simultaneous filtering operation and said second simultaneous filtering operation is a known field constant, and the sum of the outputs of said first simultaneous filtering operation and said third simultaneous filtering operation is the negative o said known fixed constant.

18. The method claimed in claim 17 wherein said detecting step further includes the steps of:

comparing the amplitude of said second simultaneous filtering operation with a fixed upper threshold level;

comparing the amplitude of said third simultaneous filtering operation with the negative of said fixed upper threshold level;

comparing the amplitude of said second simultaneous filtering operation with a fixed lower threshold level;

comparing the amplitude of said third simultaneous filtering operation with a fixed lower threshold level;

comparing the amplitude of said third simultaneous filtering operation with the negative of said fixed lower threshold level; and summing the results of all of said comparing steps to obtain a number which represents two times said known fixed constant, or minus two times said known fixed constant, or two times a different known fixed constant which equal said fixed upper threshold minus said first fixed constant.

* * * * *